US005806504A

United States Patent [19]

French et al.

[11] Patent Number: 5,806,504

[45] Date of Patent: *Sep. 15, 1998

[54] HYBRID IGNITION CIRCUIT FOR AN INTERNAL COMBUSTION ENGINE

[75] Inventors: Michael J. French, Kenosha, Wis.; Matthew Joseph Edwards, Des Plaines, Ill.

[73] Assignee: Outboard Marine Corporation, Waukegan, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 507,692

[22] Filed: Jul. 25, 1995

[51] Int. Cl.[6] ..... F02P 3/08

[52] U.S. Cl. ..... 123/605; 123/606; 123/622; 315/209 CD; 361/256

[58] Field of Search ..... 123/605, 606, 123/607, 621, 598, 622; 361/256; 315/207 T, 209 CD

[56] References Cited

U.S. PATENT DOCUMENTS

| | | | |
|---|---|---|---|
| 1,466,940 | 9/1923 | Hawkins | 123/621 |
| 1,585,402 | 5/1926 | Mallory | 123/594 |
| 1,603,071 | 10/1926 | Davies | 123/179.5 |
| 3,842,816 | 10/1974 | Vargas | 123/598 |
| 3,906,919 | 9/1975 | Asik et al. | 123/598 |
| 3,921,606 | 11/1975 | Habert | 123/599 |
| 4,228,778 | 10/1980 | Rabus et al. | 123/605 |
| 4,292,569 | 9/1981 | Gerry | 315/209 R |
| 4,327,701 | 5/1982 | Gerry | 123/598 |
| 4,345,575 | 8/1982 | Jorgensen | 123/598 |
| 4,457,285 | 7/1984 | Hamai et al. | 123/598 |
| 4,493,306 | 1/1985 | Asik | 123/620 |
| 4,562,823 | 1/1986 | Moritugu et la. | 123/620 |
| 4,677,960 | 7/1987 | Ward | 123/598 |
| 4,702,221 | 10/1987 | Tokura et al. | 123/606 |
| 4,782,242 | 11/1988 | Kovacs | 307/106 |
| 4,947,821 | 8/1990 | Somiya | 123/606 |
| 4,998,526 | 3/1991 | Gokhale | 123/598 |
| 5,178,120 | 1/1993 | Howson et al. | 123/605 |

*Primary Examiner*—Andrew M. Dolinar
*Attorney, Agent, or Firm*—Jones, Day, Reavis & Pogue

[57] ABSTRACT

An ignition circuit for an internal combustion engine. The ignition circuit includes a transformer having a secondary winding for generating a spark and having first and second primary windings, a capacitor connected to the first primary winding to provide a high energy capacitive discharge voltage to the transformer, a voltage generator connected to the second primary winding for generating an alternating current voltage, and a control circuit connected to the capacitor and to the voltage generator for providing control signals to discharge the high energy capacitive discharge voltage to the first primary winding and for providing control signals to the voltage generator to generate the alternating current voltage.

14 Claims, 2 Drawing Sheets

HYBRID IGNITION CIRCUIT FOR AN INTERNAL COMBUSTION ENGINE

BACKGROUND OF THE INVENTION

The invention relates to internal combustion engines, and particularly to ignition circuits for internal combustion engines.

Most internal combustion engines have some type of an ignition circuit to generate a spark in the cylinder. The spark causes combustion of the fuel in the cylinder to drive the piston and the attached crankshaft. Typically the engine includes a plurality of permanent magnets mounted on the flywheel of the engine and a charge coil mounted on the engine housing in the vicinity of the flywheel. As the flywheel rotates, the magnets pass the charge coil. A voltage is thereby generated on the charge coil and this voltage is used to charge a high voltage capacitor. The high voltage charge on the capacitor is released to the ignition coil via a triggering circuit thereby causing a high voltage, short duration electrical spark to cross the spark gap of the spark plug and ignite the fuel in the cylinder. This type of ignition is called a capacitive discharge ignition.

SUMMARY OF THE INVENTION

In internal combustion engines utilizing fuel injectors to inject the fuel into the cylinders, the fuel is often "stratified", i.e., atomized into a cloud combining both fuel and oxygen. In order to completely ignite the stratified cloud of fuel, it is necessary to provide an electrical spark of longer duration than is normally provided by a common capacitive discharge ignition system. Such a spark can be generated using an alternating current ("a.c.") energy source to drive the ignition coil. However, a simple alternating current energy source discharges insufficient power to initiate a spark across the spark gap of the spark plug (also called "ionizing" the spark gap). A high voltage discharge is necessary to initiate the spark, especially in the event that there are contaminants on the electrodes forming the spark gap. Such contaminants are particularly common in the marine environment. Therefore, it is desirable to provide an ignition circuit for an internal combustion engine that combines the high speed (i.e., short duration), high voltage discharge of the capacitive discharge ignition circuit with the ability to sustain combustion provided by an alternating current energy source.

Accordingly, the invention provides an ignition circuit which includes an electronic control unit ("ECU") connected to a high voltage charging capacitor, a silicon controlled rectifier ("SCR") for discharging the voltage charge on the capacitor to the ignition coil, and an alternating current generator connected to the ECU and to the charging coil for generating a sustained ignition current on the charging coil.

More specifically, the ignition circuit includes a capacitor charging circuit that may utilize either charging coils on the flywheel, direct current ("d.c.") battery voltage or residual voltage from another component such as a fuel injector to charge the ignition capacitor. The ignition capacitor is connected to a silicon controlled rectifier ("SCR") that is triggered by the electronic control unit of the ignition circuit. The ignition circuit also includes a charge coil that has three primary windings and a single secondary winding. The first of the three primary windings is connected to the SCR so that when the SCR receives a trigger signal from the ECU, the voltage on the ignition capacitor is discharged to the first primary winding thereby generating a high voltage on the secondary that causes an electrical spark to jump across or ionize the spark gap of the spark plug.

The electronic control unit is also connected to a push-pull d.c. to a.c. converter. The d.c. to a.c. converter includes a pair of transistors connected to a d.c. battery. One of the pair of transistors is connected to the second primary winding on the ignition coil while the other of the pair of transistors is connected to the third primary winding on the ignition coil. In response to signals from the ECU, the transistors are alternately energized to generate an a.c. current waveform on the secondary winding of the ignition coil. The transistors are energized by the ECU in synchronicity with the discharge of electrical energy from the capacitor in order to sustain the electrical spark across the spark gap for a sufficient amount of time to cause complete combustion of the stratified cloud of fuel.

The invention also provides an ignition circuit for an internal combustion engine, the ignition circuit comprising: a transformer having a secondary winding for generating a spark and having first and second primary windings; a capacitor connected to the first primary winding to provide a high energy capacitive discharge voltage to the transformer; voltage generator means connected to the second primary winding for generating an alternating current voltage; and control circuit means connected to the capacitor and to the voltage generator means for providing control signals to discharge the high energy capacitive discharge voltage to the first primary winding and for providing control signals to the voltage generating means to generate the alternating current voltage.

The invention also provides an ignition circuit for an internal combustion engine, the ignition circuit comprising: a transformer having a secondary winding for generating a spark and having first and second primary windings; an electronic control unit connected to the first and second primary windings, the electronic control unit generating electronic ignition signals; a capacitor connected to the first primary winding to provide a high energy capacitive discharge voltage to the transformer; switch means connected to the capacitor for discharging the high energy capacitive discharge voltage to the transformer in response to signals from the electronic control unit; and an alternating current source connected to the second primary winding for providing an alternating current voltage on the secondary winding in response to signals from the electronic control unit.

The invention also provides an ignition circuit for an internal combustion engine, the ignition circuit comprising: a transformer having a secondary winding for generating a spark and having first, second and third primary windings; an electronic control unit connected to the first, second and third primary windings, the electronic control unit generating electronic ignition signals; a capacitive discharge circuit including a silicon controlled rectifier having a cathode connected to the first primary winding, a trigger input connected to the electronic control unit and an anode, a capacitor connected to the anode, and a capacitor charging circuit connected to the capacitor to generate a high voltage on the capacitor; a direct current energy source connected to the second and third primary windings; a first transistor connected to the second primary winding, to the direct current energy source, and to the electronic control unit; and a second transistor connected to the third primary winding, to the direct current energy source, to the electronic control unit and to the first transistor.

It is an advantage of the invention to provide a capacitive discharge ignition circuit that generates an ignition signal having a sustained a.c. electrical component.

It is another advantage of the invention to provide an ignition system that delivers a reliable capacitive discharge spark that maintains a sufficient amount of energy to assure complete combustion of fuel in the cylinder.

It is another advantage of the invention to provide an ignition system that can be easily controlled with the ECU of an internal combustion engine.

Other features and advantages of the invention are set forth in the following detailed description and claims.

Figure 1:
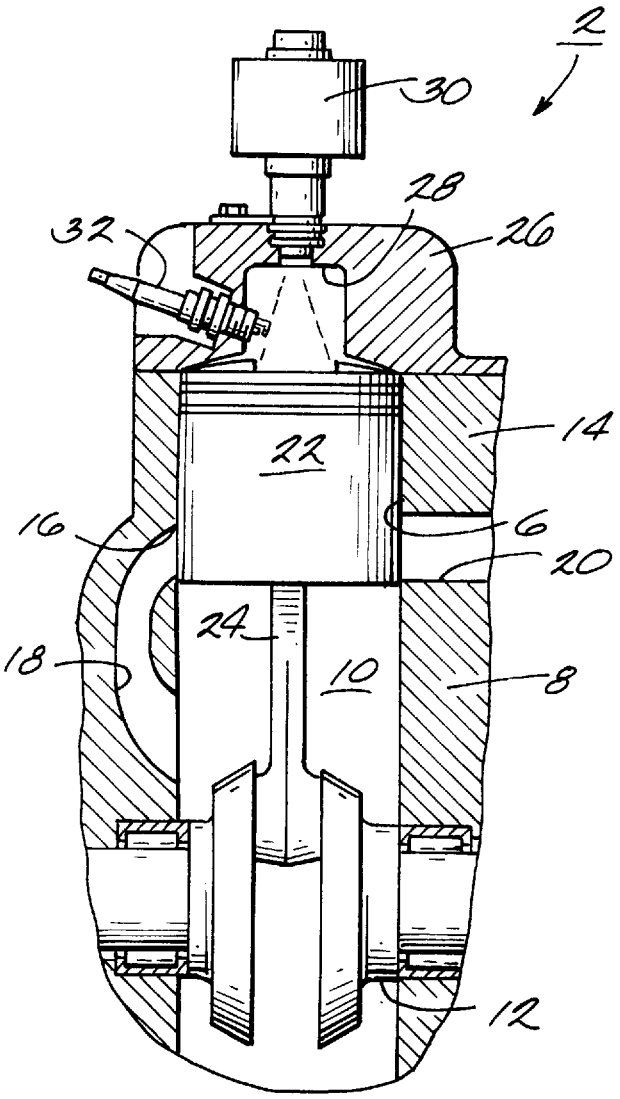
FIG. 1 is a partial cross section of an internal combustion engine embodying the invention.

Before one embodiment of the invention is explained in detail, it is to be understood that the invention is not limited in its application to the details of construction and the arrangement of components set forth in the following description or illustrated in the drawings. The invention is capable of other embodiments and of being practiced or carried out in various ways. Also, it is to be understood that the phraseology and terminology used herein is for the purpose of description and should not be regarded as limiting.

DETAILED DESCRIPTION OF THE PREFERRED EMBODIMENT

Partially shown in FIG. 1 of the drawings is an internal combustion engine 2 including a hybrid ignition circuit 4 (FIG. 2 only) for the internal combustion engine 2. One cylinder 6 of the engine 2 is illustrated in FIG. 1. The engine 2 includes a crankcase 8 defining a crankcase chamber 10 and having a crankshaft 12 rotatable therein. An engine block 14 defines the cylinder 6. The engine block 14 also defines an intake port 16 communicating between the cylinder 6 and the crankcase chamber 10 via a transfer passage 18. The engine block 14 also defines an exhaust port 20. A piston 22 is reciprocally moveable in the cylinder 6 and is drivingly connected to the crankshaft 12 by a crank pin 24. A cylinder head 26 closes the upper end of the cylinder 6 so as to define a combustion chamber 28. The engine 2 also includes a fuel injector 30 mounted on the cylinder head 26 for injecting fuel into the combustion chamber 28. A spark plug 32 is mounted on the cylinder head 26 and extends into the combustion chamber 28.

Figure 2:
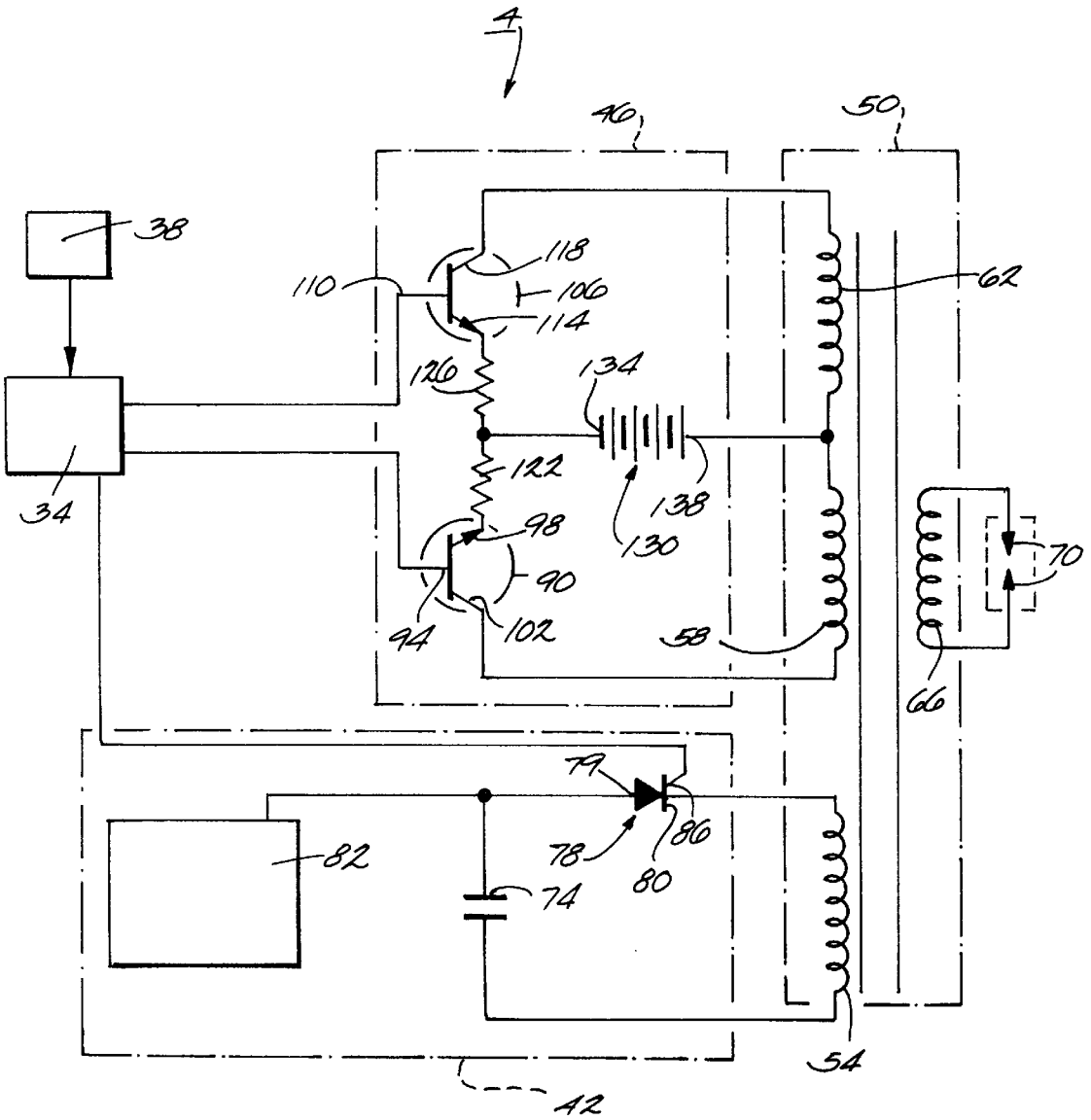
FIG. 2 is a schematic illustration of the ignition circuit for the internal combustion engine of FIG. 1.

As stated above, illustrated in FIG. 2 of the drawings is an ignition circuit 4 for controlling combustion of the fuel in the cylinder or cylinders of the internal combustion engine 2. While the ignition circuit 4 is preferably used with an internal combustion engine for a marine propulsion device, the ignition circuit 4 can be used with any internal combustion engine such as, for example, internal combustion engines used in automobiles, trucks, locomotives, etc.

The ignition circuit 4 includes an electronic control unit ("ECU") 34. The ignition circuit 4 also includes a crankshaft position sensor 38 (shown schematically only) electrically connected to the ECU 34. The crankshaft position sensor 38 is located proximal to the crankshaft 12 to detect the rotational position of the crankshaft 12 and generate an electronic signal in response thereto. The crankshaft position signal is input to the ECU 34 which utilizes the crankshaft position signal to time the ignition of the internal combustion engine 2.

In general terms, the ignition circuit 4 also includes a capacitive discharge circuit or means 42 connected to the ECU 34, an a.c. voltage generator or generator means 46 connected to the ECU 34, and a transformer 50. The transformer 50 includes a first primary winding 54 connected to the capacitive discharge circuit 42 and also includes second and third primary windings 58 and 62 connected to the a.c. voltage generator 46. The transformer 50 also includes a secondary winding 66 electromagnetically coupled to the primary windings 54, 58 and 62 of the transformer 50. The secondary winding 66 is electrically connected to a pair of electrical terminals 70. As is commonly known in the art, the spark plug 32 is connected to the electrical terminals 70 so that current passing through the primary windings 54, 58 and 62 of the transformer 50 generates a current in the secondary winding 66 of the transformer 50 thereby causing a spark to jump across or ionize the spark gap of the spark plug 32.

The capacitive discharge circuit 42 includes a high voltage capacitor 74 and an SCR 78 connected serially to the first primary winding 54 of the transformer 50, i.e., the anode 79 of SCR 78 is connected to the capacitor 74 and the cathode 80 is connected to the primary winding 54. The capacitive discharge circuit 42 also includes a capacitor charging circuit 82 connected to the capacitor 74 and to the anode 79 to generate a voltage charge that is stored on the capacitor 74. Any appropriate circuit 82 for charging the capacitor 74 can be used. For example, the electrical charge may be generated by charging coils mounted on the flywheel of the internal combustion engine 2 or, alternatively, the charge may be generated by simply connecting the capacitor 74 to a d.c. battery or another type of d.c. voltage source. The SCR 78 includes a triggering input 86 connected to the ECU 34 to receive control signals from the ECU 34 to discharge the voltage charge stored by the capacitor 74.

The alternating current voltage generator 46 includes a first transistor 90 having a base 94, an emitter 98 and a collector 102 and a second transistor 106 having a base 110, an emitter 114 and a collector 118. The bases 94 and 110 of the transistors 90 and 106, respectively, are connected to the ECU 34. The transistors 90 and 106 are connected together to form a push-pull d.c. to a.c. voltage converter. That is, emitter 98 is connected to emitter 114 through resistors 122 and 126. Collector 102 is connected to primary winding 58 and collector 118 is connected to primary winding 62. The alternating current voltage generator includes a d.c. battery 130 having a negative terminal 134 connected between resistors 122 and 126 and having a positive terminal 138 connected between primary windings 58 and 62.

In operation, the capacitor charging circuit 82 charges the capacitor 74 to approximately 300 volts. At the same time, the ECU 34 is monitoring the crankshaft position. When the ECU 34 determines (based on crankshaft position) that combustion of fuel in the cylinder is required, the ECU 34 sends an SCR gate trigger signal to the SCR 78 to discharge the 300 volt charge on the capacitor 74 to the primary winding 54. The voltage discharges through the primary winding 54 and generates a voltage on the secondary winding 66 to initiate a spark ionizing the spark gap. At approximately the same time that the spark gap is ionized, the ECU 34 generates a pair of opposite, oscillating square wave control signals to transistors 90 and 106. Transistors 90 and 106 switch "on" and "off" in push-pull fashion to generate a sufficient alternating current to sustain the ionization (or spark) for the period of time necessary to completely combust the fuel in the cylinder. Preferably, the capacitive discharge portion of the ionization has a duration of approximately 50 micro-seconds and the combined capacitive discharge and alternating current portions of the ionization has a duration of approximately 2000 to 4000 micro-seconds. If necessary, the ECU 34 can adjust the duration of the ionization so that, at higher speeds, the ignition circuit does not waste unneeded electrical power. For example, at high speeds, the total ionization duration may be reduced to as little as approximately 500 micro-seconds.

Various details of the invention are set forth in the following claims.

We claim:

1. An ignition circuit for an internal combustion engine, said ignition circuit comprising:

a transformer having a secondary winding for generating an ignition spark and having a first ignition primary winding and a separate second spark sustaining primary winding;

a capacitor connected only to said first ignition primary winding to provide a high energy capacitive discharge voltage to said transformer to initiate an ignition spark;

voltage generator means connected only to said second spark sustaining primary winding for generating an alternating current voltage that provides a sustained ignition current; and control circuit means connected to both said capacitor and said voltage generator means for providing first control signals to discharge said high energy capacitive discharge voltage only to said first ignition primary winding and for providing second control signals to said voltage generating means to generate said alternating current voltage only to said second spark sustaining primary winding to provide said sustained ignition current.

2. An ignition circuit as set forth in claim 1 wherein said control circuit means includes an electronic control unit.

3. An ignition circuit as set forth in claim 1 wherein said voltage generator means includes a direct current to alternating current converter.

4. An ignition circuit as set forth in claim 1 wherein said voltage generator means includes a pair of transistors serially connected to form a push-pull, direct current to alternating current converter.

5. An ignition circuit as set forth in claim 1 including a capacitor charging circuit for charging said capacitor.

6. An ignition circuit as set forth in claim 1 including a silicon controlled rectifier connected to said capacitor, and wherein said control circuit means includes an electronic control unit connected to said silicon controlled rectifier to selectively trigger said silicon controlled rectifier so as to discharge said capacitor to said first primary winding.

7. An ignition circuit as set forth in claim 1 including a crankshaft position sensor connected to said control circuit means.

8. An ignition circuit for an internal combustion engine, said ignition circuit comprising:

a transformer having a secondary winding for generating a spark and having first, second and third primary windings;

an electronic control unit generating electronic ignition signals;

a capacitor connected to said first primary winding to provide a high energy capacitive discharge voltage to said transformer;

switch means connected to said capacitor for discharging said high energy capacitive discharge voltage to said transformer in response to signals from said electronic control unit; and an alternating current source connected to said second and third primary windings for providing an alternating current voltage on said secondary winding in response to signals from said electronic control unit.

9. An ignition circuit as set forth in claim 8 wherein said alternating current source includes a direct current to alternating current converter.

10. An ignition circuit as set: forth in claim 8 wherein said alternating current source includes a pair of transistors serially connected to form a push-pull, direct current to alternating current converter.

11. An ignition circuit as set forth in claim 8 including a capacitor charging circuit for charging said capacitor.

12. An ignition circuit as set forth in claim 8 including a silicon controlled rectifier connected to said capacitor, and wherein said electronic control unit is connected to said silicon controlled rectifier to selectively trigger said silicon controlled rectifier so as to discharge said capacitor to said first primary winding.

13. An ignition circuit as set forth in claim 8 including a crankshaft position sensor connected to said electronic control unit.

14. An ignition circuit for an internal combustion engine, said ignition circuit comprising:

a transformer having a secondary winding for generating a spark and having first, second and third primary windings;

an electronic control unit generating electronic ignition signals;

a capacitive discharge circuit including a silicon controlled rectifier having a cathode connected to said first primary winding, having a trigger input connected to said electronic control unit, and having an anode, a capacitor connected to said anode, and a capacitor charging circuit connected to said capacitor to generate a high voltage on said capacitor;

a direct current energy source connected to said second and third primary windings;

a first transistor connected to said second primary winding, to said direct current energy source, and to said electronic control unit; and a second transistor connected to said third primary winding, to said direct current energy source, to said electronic control unit and to said first transistor.

* * * * *